United States Patent [19]

Takahisa et al.

[11] 4,294,067

[45] Oct. 13, 1981

[54] METHOD AND APPARATUS FOR DOFFING AND DONNING BOBBINS IN A SPINNING MACHINE

[75] Inventors: Shuji Takahisa, Toyota; Osamu Suzuki, Ohbu; Michio Shibano, Kariya, all of Japan

[73] Assignee: Kabushiki Kaisha Toyoda Jidoshokki Seisakusho, Aichi, Japan

[21] Appl. No.: 114,361

[22] Filed: Jan. 22, 1980

[30] Foreign Application Priority Data

Jan. 25, 1979 [JP] Japan ..... 54-8023

[51] Int. Cl.[3] ..... D01H 9/08; D01H 9/02

[52] U.S. Cl. ..... 57/274

[58] Field of Search ..... 57/270, 273, 274, 275

[56] References Cited

U.S. PATENT DOCUMENTS

| | | | |
|---|---|---|---|
| 3,370,411 | 2/1968 | Schulz et al. | 57/274 |
| 3,786,621 | 1/1974 | Pray et al. | 57/274 |
| 3,791,123 | 2/1974 | Kawauchi | 57/274 |
| 3,827,227 | 8/1974 | Pray et al. | 57/274 |

FOREIGN PATENT DOCUMENTS 50-29056 9/1975 Japan .

*Primary Examiner*—John Petrakes

*Attorney, Agent, or Firm*—Wenderoth, Lind & Ponack

[57] ABSTRACT

A bobbin doffing and donning method and apparatus are disclosed, wherein a stop is selectively projected into a path, along which an engaging member, mounted on a suitable portion of a power transmission mechanism structurally associating a doffing bar with a piston and cylinder assembly for tilting the doffing bar, is moved by the piston and cylinder assembly, to allow the engaging member to pressure contact with the stop thereby stopping the doffing bar at an intermediately tilted condition under which the doffing bar can operate on bobbins temporarily placed on a refuge support positioned between a succession of spindles and a bobbin conveyor both arranged along the side of a spinning machine.

In order to release the doffing bar from the intermediately inclined condition, fluid is supplied into the piston and cylinder assembly so as to temporarily move the engaging member in a direction in which it disengages from the stop and thereafter the stop is moved out of the path of the engaging member.

7 Claims, 13 Drawing Figures

FIG. 4
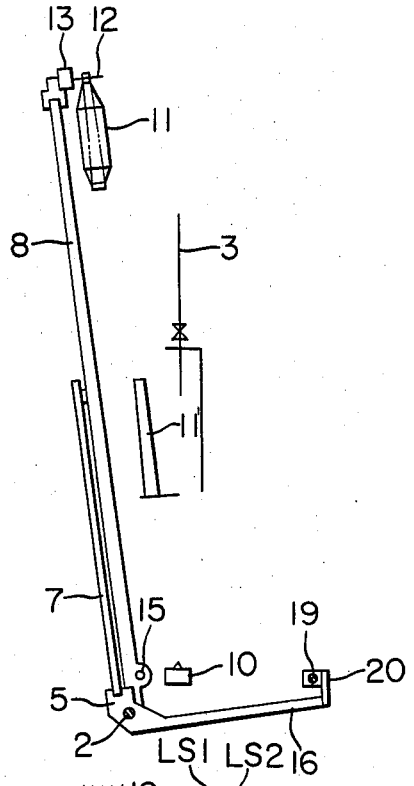
FIG. 4A
FIG. 5
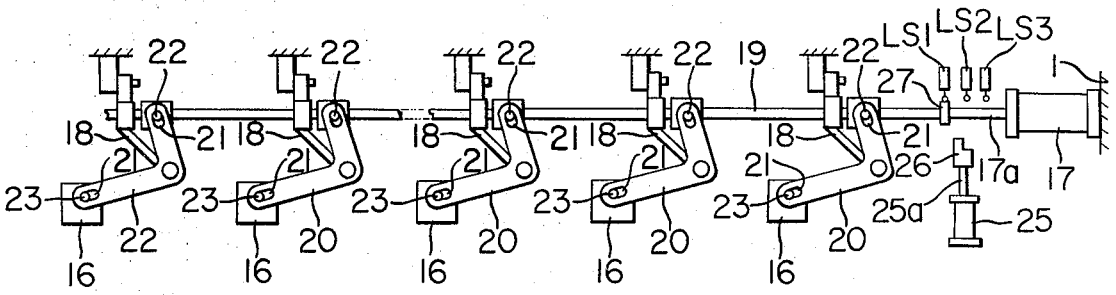

METHOD AND APPARATUS FOR DOFFING AND DONNING BOBBINS IN A SPINNING MACHINE

BACKGROUND OF THE INVENTION

This invention relates to a bobbin doffing and donning method and apparatus, applicable to a spinning machine, of the type which comprises a single conveyor and a refuge support, either full bobbins or empty bobbins being temporarily placed on the refuge support on the way thereof from the spindles of the spinning machine to the conveyor or vice versa.

In the above-mentioned type of conventional doffing apparatus, a doffing bar with a number of bobbin holders is generally included so that all the full bobbins on the spindles on each side of the spinning machine are doffed simultaneously by moving the doffing bar in predetermined sequence with respect to the spindles. Typically, such a motion of the doffing bar includes swinging, upward and downward movement of the same. Also, the swinging movement is generally effected by causing the doffing bar to turn about a shaft extending therealong by means of a piston and cylinder assembly.

In order to temporarily place the empty bobbins on the refuge support positioned between the row of spindles and the conveyor, the doffing bar has to be temporarily maintained in an intermediately inclined condition, under which the bobbin holders supported by the doffing bar with the empty bobbins can place the latter on the refuge support. For this purpose, the doffing apparatus is provided with means associated with the piston and cylinder assembly for restraining the doffing bar in the intermediately inclined condition.

However, since the piston and cylinder assembly has essentially no function of allowing the piston itself to temporarily stop at any intermediate position between the ends of a stroke thereof, the restraining means including a stop to constrain the piston at its intermediate position is necessarily subject to the force produced by a pressure applied on the piston. Therefore, in order to release the stop of the restraining means from the piston constraining position thereof against the pressure in the cylinder, considerable power is required to operate the restraining means, resulting in an increased capacity of the restraining means. Moreover, upon release of the restraining means, the restoration of the movement of the doffing bar to another condition by the piston and cylinder assembly causes an impact on the doffing bar and the associated parts. This results in the prevention of a smooth doffing operation.

it is therefore a principal object of this invention to provide a bobbin doffing and donning method and apparatus, which requires much less power to release the means for restraining a doffing bar from an operative position, and which ensures a stable and smooth doffing operation.

SUMMARY OF THE INVENTION

Generally, this invention relates to a method and apparatus for removing full bobbins from a succession of spindles of a spinning machine and applying empty bobbins to the spindles from which the full bobbins have been removed. The apparatus comprises bobbin conveying means extending along the side of the spinning machine, means disposed between the succession of spindles and the bobbin conveying means and along the side of the spinning machine for temporarily receiving the bobbins, a tiltable and vertically movable doffing bar extending along the side of the spinning machine, a succession of bobbin holders supported by the doffing bar so as to be arranged at the same intervals as the spindles, and means for tilting and vertically moving the doffing bar so that the bobbin holders supported by the doffing bar can operate on the bobbins on the spindles, the bobbin temporary receiver and the bobbin conveying means. The tilting means includes a first air operated piston and cylinder assembly with a reciprocating piston rod, and a mechanism connected between the piston rod and the doffing bar for converting the reciprocating movement of the piston rod to the tilting movement of the doffing bar. The apparatus further comprises means for maintaining the doffing bar at an intermediately tilted condition under which the bobbin holders can operate on the bobbins on the bobbin temporary receiver. The maintaining means includes an engaging member mounted on a portion of the converting mechanism, and a second air operated piston and cylinder assembly having a stop selectively movable into a path, along which the engaging member is moved by the first piston and cylinder assembly, to allow the engaging member to pressure contact with the stop thereby stopping the doffing bar at the intermediately tilted condition.

According to the present invention, the apparatus further comprises means for temporarily supplying air into the first piston and cylinder assembly so as to cause the engaging member to be disengaged from the stop in the path of the engaging member before the stop is moved out of the path of the engaging member in order to release the doffing bar from the intermediately tilted condition.

BRIEF DESCRIPTION OF THE DRAWINGS

This invention will become more readily apparent from the following detailed description of the preferred embodiments thereof shown, by way of example only, in the accompanying drawings, wherein:

FIGS. 2 to 4 and FIGS. 2A to 4A are diagrammatic views for explaining the successive doffing and donning steps according to this invention;

FIG. 5 is a front view of a mechanism for turning a doffing bar of the doffing apparatus;

DESCRIPTION OF THE PREFERRED EMBODIMENTS

Figure 1:
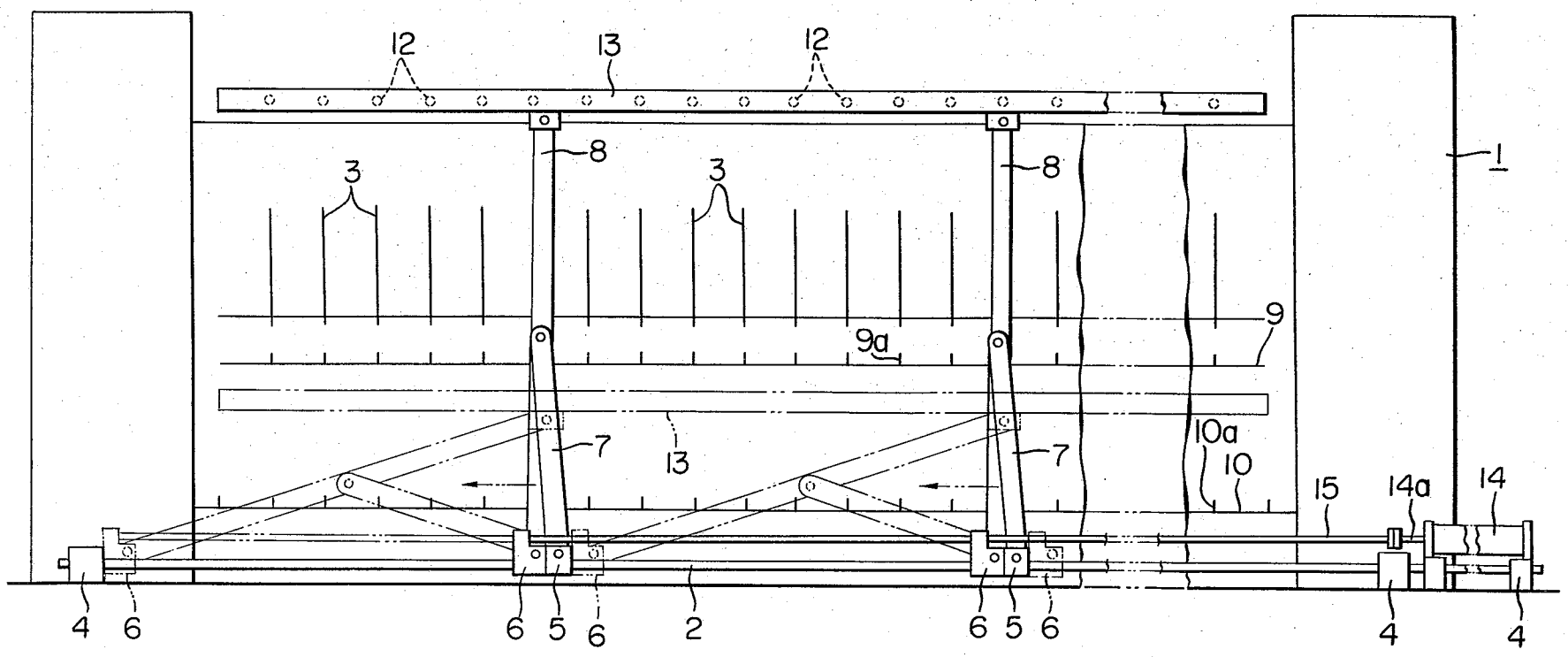
FIG. 1 is a front elevational view diagrammatically showing a spinning machine to which the present invention is applicable.

Referring now to the drawings and, in particular, to FIG. 1, there is shown, by way of example, a spinning frame to which the present invention is applicable. Although the following description will be made in conjunction with the spinning frame, the invention is clearly not limited thereto. The spinning frame comprises a succession of individual spindles 3 carried for rotation by a frame structure 1 in a conventional manner. In order to automatically doff full bobbins or wound packages (shown at 11 in FIG. 2) on the spindles 3 and to replace them with empty bobbins 11' (see FIG. 2), a doffing and donning apparatus is provided along the side of the spinning frame.

The doffing and donning apparatus comprises a turnable shaft 2 disposed in front of the lower portion of the frame structure 1 so as to extend longitudinally along the succession of spindles 3. The shaft 2 is supported for rotation in conventional bearings 4 on a floor and provided with a suitable number of equispaced stationary brackets 5 (preferably seven brackets) fixed thereto and the same number of movable brackets 6 as that of the stationary brackets 5 loosely mounted on the shaft 2 for axial movement. Each of the stationary brackets 5 has the lower end of a short lever 7 pivotally connected thereto, and each of the movable brackets 6 has the lower end of a long lever 8 pivotally connected thereto, the upper end of each of the short levers 7 being pivotally connected to the substantially mid portion of the corresponding long lever 8. The upper ends of the long levers 8 are pivotally connected to a doffing bar 13 extending in parallel with the shaft 2. The doffing bar 13 is provided with a succession of bobbin holders 12 positioned at the same intervals as the spindles 3. Therefore, it is understood that the doffing bar 13 can be moved upward and downward by moving the movable brackets 6 along the shaft 2 and can be turned toward and away from the side of the spinning frame by rotating the shaft 2. The holder 12 is adapted to hold the upper portion of the full bobbin 11 or empty bobbin 11' in a conventional manner.

In order to cause the axial movement of the brackets 6, a piston and cylinder assembly 14 is mounted at the right-hand end of the shaft 2 for rotation about the latter. A piston rod 14*a* of the assembly 14 is fixedly connected to one end of a reciprocating rod 15 extending in parallel with the shaft 2 and through the movable brackets 6. Since the brackets 6 are fixed to the rod 15, they can be moved rightward or leftward in FIG. 1 by retracting or extending the piston rod 14*a* of the assembly 14, thereby causing the doffing bar 13 to move upward or downward.

In order to turn the doffing bar 13 about the shaft 2, an arrangement as best shown in FIGS. 2 to 4 and 2A to 4A is provided, which comprises levers 16 formed integrally with the respective stationary brackets 5 and extending inwardly of the frame structure. Therefore, it can be understood that by turning the levers 16 upward or downward about the shaft 2 the doffing bar 13 is also turned about the shaft 2.

As best shown in FIG. 5, at the lower portion of the frame structure 1, a first piston and cylinder assembly 17 is fixedly mounted with its piston rod 17*a* being connected to one end of a pull rod 19, which is supported in parallel with the shaft 2 and is for axial movement by a plurality of support members 18 fixed to the frame structure 1. The support members 18 correspond in number to the levers 16 and in position substantially to the free ends of the levers 16.

Figure 2:
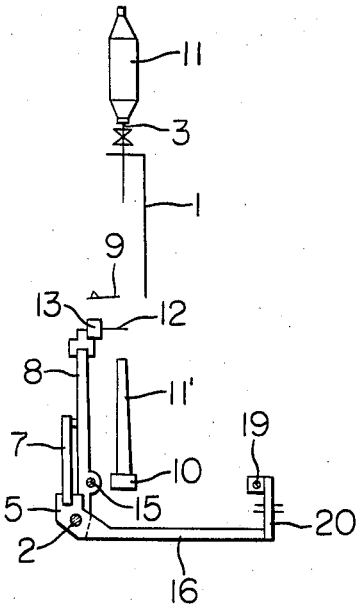
Figure 3:
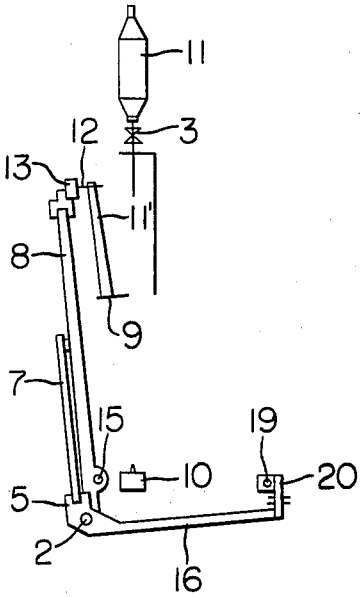

Also, as shown in FIG. 5, to the lower end of each support member 18, a substantially L-shaped lever 20 is pivotally connected at the bend thereof. Provided in the opposite ends of the L-shaped lever 20 are oblong openings 21 in which a pin 22 fixed to the periphery of the pull rod 19 and a pin 23 provided on the extremity of the respective levers 16 are engaged respectively. Therefore, when the piston rod 17*a* of the first piston and cylinder assembly 17 is moved leftward or rightward in FIG. 5, the inner ends of the lever 16 are turned downward or upward through the pull rod 19 and the L-shaped levers 20, whereby the doffing bar 13 is allowed to assume any of the conditions shown in FIGS. 2 to 4. In FIG. 2, the holders 12 supported by the doffing bar 13 are in alignment with the empty bobbins 11' carried on respective pegs 10*a* (FIG. 1) extending upwardly from a conveyor 10 capable of running along the side of the spinning frame 1. In FIG. 3, the holders 12 can temporarily place the empty bobbins 11' on a refuge support 9 extending along the side of the spinning frame with a number of upwardly extending page 9*a* (FIG. 1) spaced at the same intervals as the spindles 3. The doffing bar 13 shown in FIG. 4 is in a leftmost inclined position, which is assumed after the full bobbins 11 have been doffed from the spindles 3 by the respective holders 12.

Figure 6:
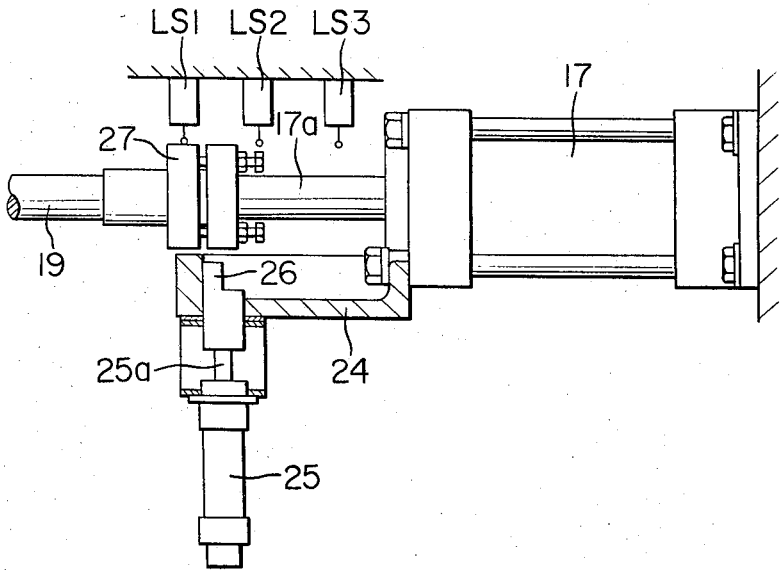
FIG. 6 is a front view of means for restraining the doffing bar in its inoperative position.
Figure 7:
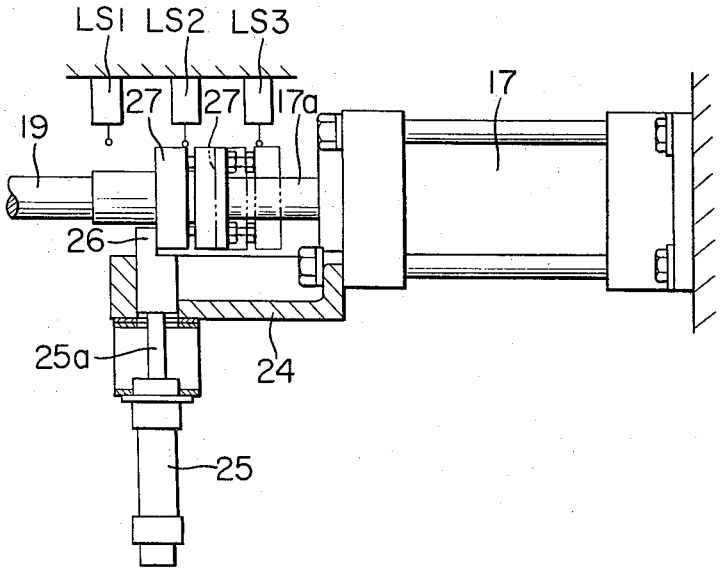
FIG. 7 is a front view of the restraining means in its operative position.

As shown in FIGS. 6 and 7, mounted on the lower end portion of the cylinder of the first piston and cylinder assembly 17 is a bracket 24, which supports a second piston and cylinder assembly 25 comprising a piston rod 25*a* provided with a stop 26. At the junction between the piston rod 17*a* of the first piston cylinder assembly 17 and the pull rod 19, a substantially cylindrical engaging member 27 is provided in an adjustable manner with respect to its axial position. Therefore, when the piston rod 25*a* of the second piston and cylinder assembly 25 extends toward the engaging member 27 to drive the stop 26 into the path of the engaging member 27 and then the engaging member 27 seats on the stepped portion 26*a* of the stop 26 as shown in FIG. 7, the doffing bar 13 and the associated members can be maintained in the intermediately inclined position shown in FIG. 3. As stated above, the doffing bar 13 in this intermediately inclined position can operate on the refuge support 9 so as to temporarily place the empty bobbins 11' on the pegs 9*a* of the refuge support 9 and remove them from the same.

Figure 2A:
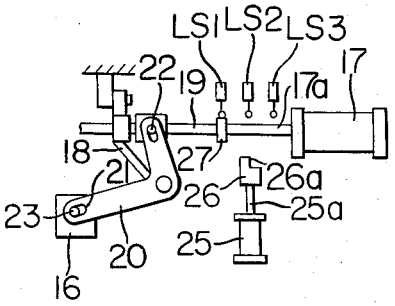
Figure 3A:
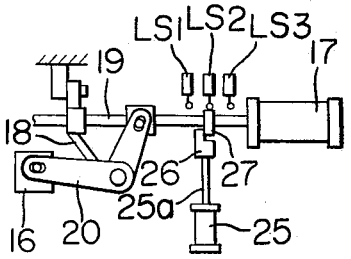

In FIGS. 2, 2A and 6, when the piston rod 17*a* of the first piston and cylinder assembly 17 is projected leftward to cause the doffing bar 13 to assume the lower upright position, in which the doffing bar 13 can operate on the conveyor 10, the engaging member 27 is in operative contact with a first limit switch LS1 mounted on the frame structure 1, thus detecting the lower upright position of the doffing bar 13. Also, a second limit switch LS2 is provided in a position, in which it is operated as best shown in FIG. 7 by the engaging member 27 when the doffing bar 13 assumes the intermediately inclined position shown in FIG. 3. Thus, the second limit switch can detect the intermediate inclined position of the doffing bar 13, and after detection of the intermediate inclined position the second limit switch LS2 causes the piston rod 17*a* of the first piston and cylinder assembly 17 to be retracted for a purpose as will be described hereinafter. The leftmost inclined position of the doffing bar 13 as shown in FIG. 4 can be detected in a similar manner by a third limit switch LS3, which is positioned so as to be operated by the engaging member 27 shown by the dashed line in FIG. 7 when the piston rod 17*a* of the first piston and cylinder assembly 17 is fully retracted, i.e., moved to its rightmost position.

Figure 8:
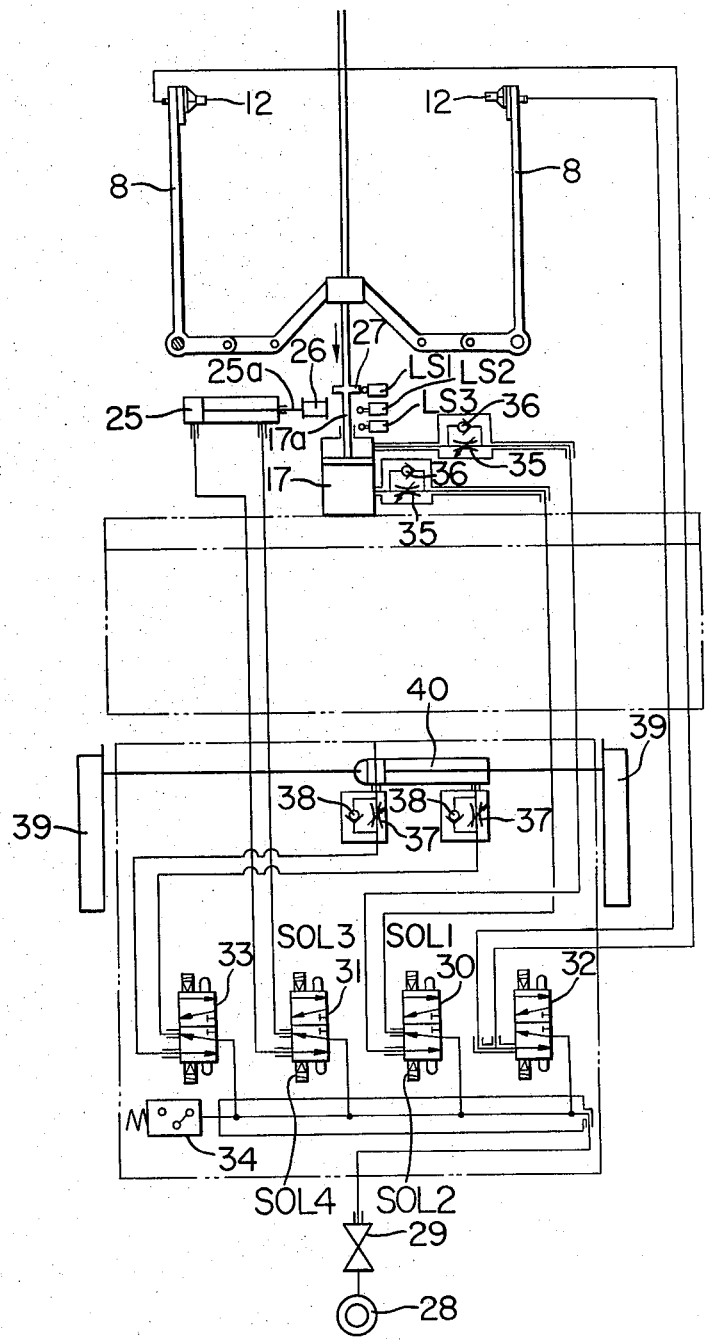
FIG. 8 is a schematic view showing an air circuit for operating a piston and cylinder assembly of the restraining means shown in FIGS. 6 and 7.

An air circuit for controlling operation of the first and second assemblies 17 and 25 is illustrated in FIG. 8. The circuit includes an air pump or compressor 28, to which four electromagnetic change-over valves 30 to 33 are connected in parallel with each other through a stop valve 29. Also, a pressure operated switch 34 is provided between the stop valve 29 and the set of change-over valves 30 to 33.

The first change-over valve 30 is adapted to supply air into the cylinder of the first piston and cylinder assembly 17 either on the side of the piston rod 17*a* when a solenoid SOL1 of the first valve 30 is energized, thus causing the piston rod 17*a* to be retracted in the cylinder, or on the side opposite to the piston rod side when a solenoid SOL2 is energized, thus causing the piston rod 17*a* to be moved in the opposite direction. In the circuits between the first change-over valve 30 and the ports provided in the cylinder of the first piston and cylinder assembly 17, there are sets of flow control valves 35 and check valves 36 each set forming a so-called meter out circuit.

The second change-over valve 31 is associated with the second piston and cylinder assembly 25 so that air is supplied into the cylinder either on the side opposite to the piston rod 25*a* when a solenoid SOL3 is energized or on the side of the piston rod 25*a* when a solenoid SOL4 is energized. It is therefore understood that upon energization of the solenoid SOL3 the piston rod 25*a* is extended and conversely, upon energization of the solenoid SOL4, the piston rod 25*a* is retracted into the cylinder.

The third change-over valve 32 is associated with the holders 12 and the fourth change-over valve 33 is connected to an air operated piston and cylinder assembly 40 through flow control valves 37 and check valves 38. The assembly 40 is to operate an empty bobbin supply hopper 39 so that it is inclined in a position directly above the conveyer 10 (FIG. 1) when it is necessary to supply the conveyer 10 with the empty bobbins 11'.

Figure 9:
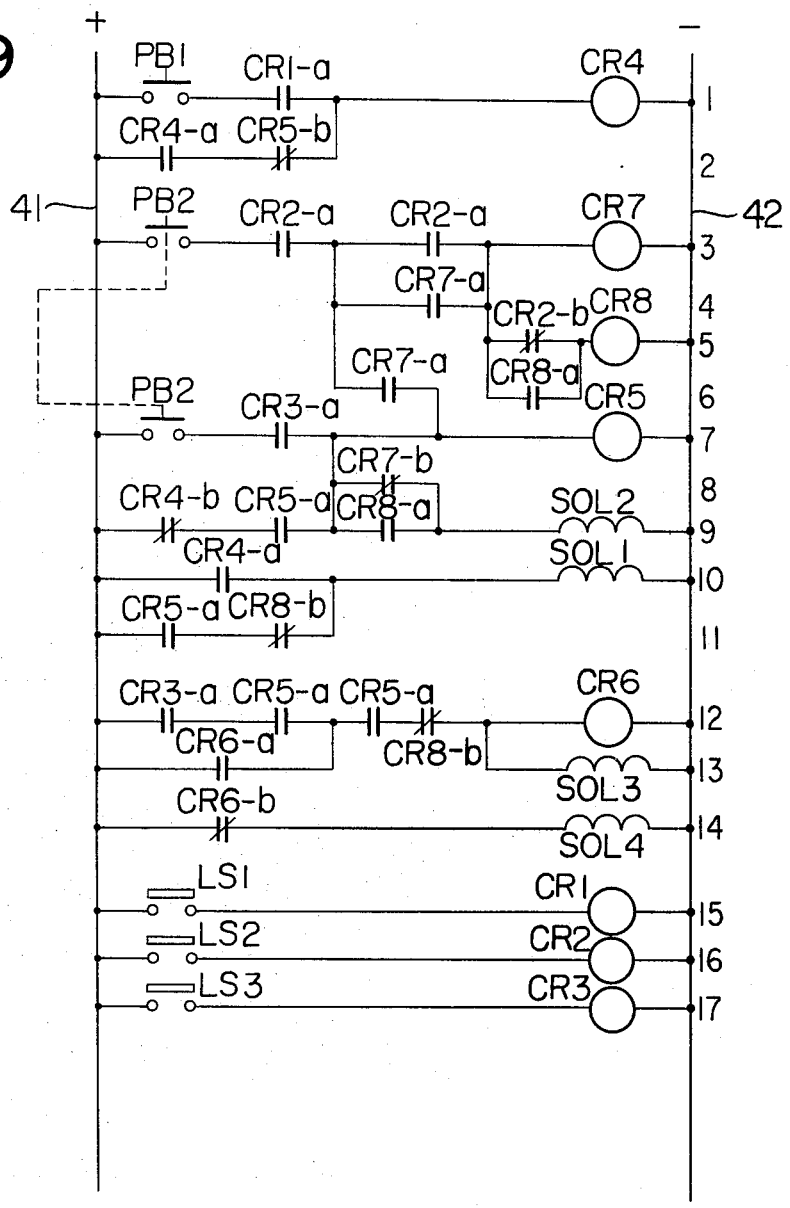
FIG. 9 is a circuit diagram of an electric circuit for bringing the restraining means into the inoperative position.

FIG. 9 shows an electric circuit for disengaging the stop 26 from the engaging member 27 in accordance with the teachings of the present invention. This circuit includes buses 41 and 42, connected to a not shown source of electricity, between which a number of circuits 1 to 17 are connected.

A doffing and donning operation will now be described in detail with reference mainly to FIGS. 2 to 4, 2A to 4A and 9.

In FIG. 2A, the piston rod 17*a* of the first piston and cylinder assembly 17 is fully extended to place the pull rod 19 in the leftmost position as also shown in FIG. 5. At that time, the extremities or free ends of the swinging levers 16 are maintained in their lowermost position and therefore the doffing bar 13 assumes the upright position. Under such conditions, when a signal indicating that a predetermined length of yarn has been wound on each bobbin is issued in a conventional manner, the piston and cylinder assembly 14 operates to slightly lower the doffing bar 13 so that the holders 12 on the doffing bar 13 can hold the upper portions of the respective empty bobbins 11' supported on the conveyer 10.

Then, a push-button switch PB1 in circuit 1 of FIG. 9 is switched on. Since the limit switch LS1 in circuit 15 has been closed by the engaging member 27, a control relay CR1 in circuit 15 is picked up to close its normally open contacts CR1-a in circuit 1. Therefore, a control relay CR4 is picked up and self-maintained in the picked up condition by its normally open contacts CR4-a in circuit 2, while at the same time normally closed contacts CR4-b in circuit 9 are opened and normally open contacts CR4-a in circuit 10 are closed thereby to energize the solenoid SOL1 in circuit 10. Therefore, as stated above, the piston rod 17*a* of the first piston and cylinder assembly 17 is fully retracted in the cylinder and the doffing bar 13 is brought into the leftmost inclined position. It is to be noted that malfunction of the solenoid SOL2 can be prevented, since normally closed contacts CR4-b in circuit 9 are opened upon energization of the control relay CR4.

After completion of the movement of the doffing bar 13 to its leftmost inclined position, the doffing bar 13 is moved upward by operating the piston and cylinder assembly 14 until the lower ends of the empty bobbins 11' held by the respective holders 12 mounted on the doffing bar 13 are brought into their position substantially corresponding in level to the refuge support 9. At that time, the third limit switch LS3 in circuit 17 is closed by the engaging member 27 and therefore a control relay CR3 in circuit 17 is picked up to close its normally open contacts CR3-a provided in circuits 7 and 12.

Then, push-button switches PB2 provided in circuits 3 and 7 are switched on to cause the doffing bar 13 to turn inwardly or toward the frame structure 1. Since the contacts CR3-a in circuits 7 and 12 have been closed, a fifth control relay CR5 in circuit 7 is picked up upon energization of the switches PB2 thereby to cause its normally closed contacts CR5-b in circuit 2 to be opened. Thus, the relay CR4 is dropped out and normally closed contacts CR4-b thereof in circuit 9 are closed. Since both normally open contacts CR5-a of the relay CR5 in circuit 9 and normally closed contacts CR7-b in circuit 8 are closed at that time, the solenoid SOL2 in circuit 9 is energized to cause the piston rod 17*a* of the first piston and cylinder assembly 17 to be extended so that the doffing bar 13 is turned inwardly or toward the frame structure 1. Simultaneously with the energization of the fifth relay CR5, normally open contacts CR5-a connected in circuit 12 are closed. Also, in circuit 12, since both the normally open contacts CR3-a and normally closed contacts CR8-b are closed, a sixth control relay CR6 in circuit 12 and the solenoid SOL3 in circuit 13 are picked up and self-maintained in the picked up condition by the closed, normally open contacts CR6-a. Therefore, the picked up solenoid SOL3 causes the piston rod 25*a* of the second piston and cylinder assembly 25 to be extended so as to drive the stop 26 connected thereto into the path along which the engaging member 27 moves, thereby stopping the engaging member 27 at the intermediate position. Thus, the doffing bar 13 can be maintained in the intermediate inclined condition shown in FIG. 3.

Although both the piston rods 17*a* and 25*a* of the first and second assemblies 17 and 25 are simultaneously extended upon energization of the fifth relay CR5, the stop 26 mounted on the piston rod 25*a* ensures that the engaging member 27 stops at the afore-mentioned intermediate position, since the piston rod 25*a* is adapted to move at a greater speed than that of the piston rod 17*a* due to the fact that a much smaller load is applied to the second piston and cylinder assembly 25 than to the first piston and cylinder assembly 17.

In addition, it is stated that there is no possibility of malfunction of the solenoid SOL4 while the doffing bar 13 is in the intermediately inclined condition, since normally closed contacts CR6-b of the relay CR6 in circuit 14 are kept closed. Thus, the piston rod 25*a* can not be retracted.

After the doffing bar 13 has been brought into the intermediately inclined condition, it is slightly lowered by operating the piston and cylinder assembly 14 so as to cause the empty bobbins 11' held by the respective holders 12 to be fitted onto the pegs 9*a* mounted on the refuge support 9. Therefore, if the empty bobbins 11' are released from the respective holders 12, they can be temporarily placed on the refuge support 9. Thereafter, the doffing bar 13 is raised to a position substantially corresponding in level to the upper ends of the full bobbins 11 on the respective spindles 3.

Under the condition that the engaging member 27 is engaged in the stop 26, the doffing bar 13 is maintained in the intermediately inclined position, in which it can operate on the refuge support 9 as shown in FIG. 3, and the limit switches LS1 and LS3 in circuits 15 and 17 are open. The second limit switch LS2 in circuit 16 is closed by the engaging member 27 and therefore the second relay CR2 in the same circuit 16 is picked up thereby to close the normally open contacts CR2-a in circuit 3 and open the normally closed contacts CR2-b in circuit 5.

If the push-button switch PB2 is made "on" again under the above-mentioned circumstances, the seventh control relay CR7 is picked up to cause its normally open contacts CR7-a connected in circuits 4 and 6 to be closed, and the fifth control relay CR5 in circuit 7 is also picked up to cause the normally open contacts CR5-a in circuit 9 to be closed. At that time, the normally closed contacts CR4-b in circuit 9 are maintained in their closed state. Thus, it is understood that both the relay CR7 in circuit 3 and the relay CR5 in circuit 7 are self-maintained in their energized state. Therefore, the normally open contacts CR5-a of the fifth relay CR5 in circuit 11 are closed, and the solenoid SOL1 in circuit 10 is energized since the normally closed contacts CR8-b are maintained in their closed state. This causes the piston rod 17*a* of the first piston and cylinder assembly 17 to be retracted, whereby the engaging member 27 is disengaged from the stop 26 and opens the second limit switch LS2. The relay CR2 is dropped out to cause the normally closed contacts CR2-b in circuit 5 to be converted to the closed state and an eighth control relay CR8 in circuit 6 to be picked up. The relay CR8 can be self-maintained in the energized state by the closed, normally open contacts CR8-a in circuit 6. Since the normally closed contacts CR8-b of the relay CR8 in circuit 12 are opened, both the relay CR6 in circuit 12 and the solenoid SOL3 in circuit 13 are deenergized. Therefore, the normally closed contacts CR6-b in circuit 14 revert to their closed state and the solenoid SOL4 is energized, thus causing the piston rod 25*a* of the second piston and cylinder assembly 25 to be retracted to bring the stop 26 out of the path of the movement of the engaging member 27. At the same time as the energization of eighth relay CR8, the normally open contacts CR8-a thereof in circuit 9 are closed and the solenoid SOL2 is energized, whereby the doffing bar 13 is turned toward the spindles 3 into the upright condition. At that time, the normally closed contacts CR8-b of the relay CR8 in circuit 11 are converted to the opened state, the solenoid SOL1 is prevented from malfunction.

Under the upright condition of the doffing bar 13, it is slightly lowered to hold the full bobbins 11 with the respective holders 12 and then raised to doff the full bobbins 11 from the respective spindles 3.

Then, if the push-button switch PB1 in circuit 1 is operated, the doffing bar 13 is turned to the leftmost inclined position shown in FIG. 4 as stated above. The doffing bar 13 is thereafter lowered to the lower position and then turned to the upright position to place the full bobbins 11 onto the respective pegs 10*a* on the conveyer 10. Thereafter, in the same procedure as stated above the doffing bar 13 is turned to the leftmost inclined condition, under which it is then raised to the position substantially corresponding in height to the upper ends of the empty bottins 11' supported on the refuge support 9. The doffing bar 13 is turned to the intermediately inclined position, in which the holders 12 on the doffing bar 13 can hold the respective empty bobbins 11' on the refuge support 9. The doffing bar 13 with the empty bobbins 11' is further raised to the uppermost position under the intermediately inclined condition and then turned rightward to the upright condition, under which the empty bobbins 11' are transferred from the holders 12 onto the respective spindles 3. Thereafter, the doffing bar 13 is returned to the upright rest position as shown in FIG. 2. Thus, the doffing and donning operation is completed.

According to the present invention, the piston rod 25*a* of the second piston and cylinder 25 is extended to bring the stop 26 into the path of the engaging member 27, thus allowing the engaging member 27 to pressure contact against the stop 26 and the doffing bar 13 to stop at the intermediately inclined position. Before the stop 26 is brought out of the path of the engaging member 27, the piston rod 17*a* of the first piston and cylinder assembly 17 is retracted by a predetermined amount by the action of the second limit switch LS2 to disengage the engaging member 27 from the stop 26. Thereafter, the stop 26 is retracted to release the restraining force applied on the engaging member 27 to restrain the doffing bar 13 to the intermediately inclined position. Therefore, it is understood that less power is required to retract the stop 26 from the path of the engaging member 27. This not only makes it possible to minimize the size of the second piston and cylinder assembly 25, but also results in a smooth doffing and donning operation, since the possible impact applied on the doffing bar 13 and the associated parts when the doffing bar is released from its intermediately inclined condition is greatly reduced as compared with the prior art, wherein the stop 26 has been forcibly retracted from engagement with the engaging member 27.

Although in the first embodiment of this invention the engaging member 27 is attached to the junction between the piston rod 17*a* of the first piston and cylinder assembly 17 and the pull rod 19, it may be mounted on the end of the pull rod 19 or a portion of the connecting lever 20. Moreover, in the first embodiment, when the doffing bar is released from its intermediately inclined condition, air is supplied into the cylinder of the first piston and cylinder assembly 17 on the piston rod side thereof to cause the piston rod 17*a* to be retracted, thereby disengaging the engaging member 27 from the stop 26, and the amount of the retraction is selected to a predetermined value through which the engaging member 27 allows the second limit switch SL2 to become inoperative. However, instead of this limit switch LS2, an instantaneous release timer may be utilized to control a retracted amount of the piston rod 17*a* by causing the first piston and cylinder assembly 17 to be operative for a predetermined periord of time set by the timer.

Figure 10:
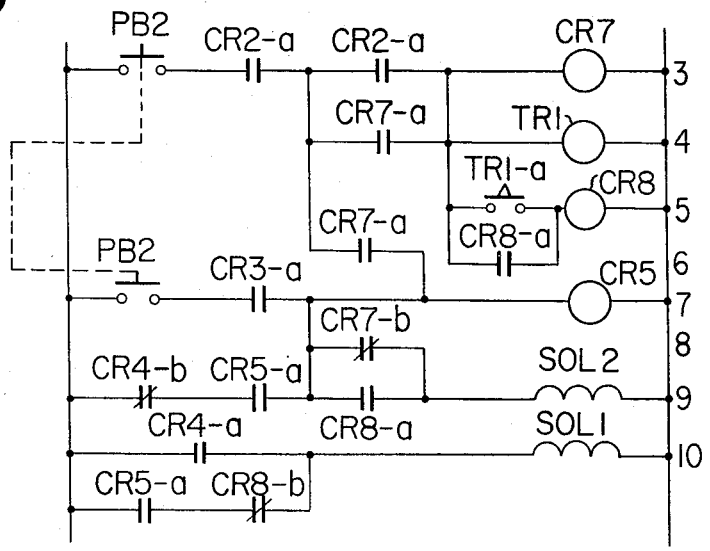
FIG. 10 is a circuit diagram showing a modification of the electric circuit shown in FIG. 9.

Essential parts of an electric circuit for another embodiment utilizing such a timer are shown in FIG. 10, wherein under the intermediately inclined condition of the doffing bar 13 if the push-button switch PB2 in circuit 3 is pushed down, both the seventh relay CR7 in circuit 3 and the fifth relay CR5 in circuit 7 are self-maintained in their picked up condition. When the solenoid SOL1 in circuit 10 is energized, the doffing bar 13 is turned to the most inclined condition. A first timer TR1 connected in parallel with the seventh relay CR7 is set to control a time at which the engaging member 27 is disengaged from the stop 26. When the first timer TR1 counts up a preset period of time, an eighth relay CR8 in circuit 5 is picked up, whereby the solenoids SOL2 and SOL4 are energized and the doffing bar 13 is turned to the upright condition.

However, since the preset period of time set by this timer is constant irrespective of changes in the load applied on the first piston and cylinder assembly 17, a length through which the piston rod moves during the preset period of time changes dependent on whether or not the doffing bar 13 carries the full bobbins 11. Therefore, it is required that the preset period of time be prolonged when the doffing bar holds the full bobbins 11.

It is therefore understood from the foregoing that this invention relates to an automatic bobbin doffing and donning apparatus, wherein the stop acting as means for restraining the doffing bar to the intermediately inclined condition is projected into the path of the engaging member mounted on the suitable portion of the mechanism operatively and structurally associating the doffing bar with the piston and cylinder assembly for inclining the doffing bar, thereby allowing the engaging member to pressure contact against the stop to stop the doffing bar at the intermediately inclined condition, under which the doffing bar can operate on the refuge support. According to the present invention, when it is required to release the doffing bar from the intermediately inclined condition, air is supplied into the piston and cylinder assembly for inclining the doffing bar so as to cause the engaging member to be disengaged from the stop. During the time that the engaging member is thus disengaged from the stop, the latter is retracted out of the path of the engaging member. This enables the use of a small-sized piston and cylinder assembly for restricting the doffing bar to the intermediately inclined position, and results in a smooth bobbin doffing and donning operation.

What we claim is:

1. An apparatus for removing full bobbins from a succession of spindles of a spinning machine and applying empty bobbins to the spindles from which the full bobbins have been removed, said apparatus comprising:

bobbin conveying means extending along the side of the spinning machine;

means disposed between the succession of spindles and said bobbin conveying means and along the side of the spinning machine for temporarily receiving the bobbins;

a tiltable and vertically movable doffing bar extending along the side of the spinning machine;

a succession of bobbin holders supported by said doffing bar so as to be arranged at the same intervals as the spindles;

means for tilting and means for vertically moving said doffing bar so that said bobbin holders supported by said doffing bar can operate on the spindles, said bobbin temporary receiving means and said bobbin conveying means;

said tilting means including a first piston and cylinder assembly with a reciprocating piston rod, and a mechanism connected between said piston rod and said doffing bar for converting reciprocating movement of said piston rod to tilting movement of said doffing bar between opposite end positions and an intermediate position;

means for maintaining said doffing bar at said intermediate position whereat said bobbin holders can operate on the bobbins on said bobbin temporary receiving means, said maintaining means including an engaging member mounted on a portion of said converting mechanism, and a second piston and cylinder assembly having a stop selectively movable into a path, along which said engaging member is moved by said first piston and cylinder assembly, to allow said engaging member to pressure contact with said stop, thereby stopping said doffing bar at said intermediate position; and means for supplying fluid into said first piston and cylinder assembly so as to cause said engaging member to be disengaged from said stop in the path of said engaging member before said stop is moved out of the path of said engaging member in order to release said doffing bar from said intermediate position.

2. An apparatus according to claim 1, wherein said portion on which said engaging member is mounted comprises the piston rod of said first piston and cylinder assembly.

3. An apparatus according to claim 1, wherein said fluid supply means includes first and second solenoid valves associated with said first piston and cylinder assembly, and a limit switch arranged for controlling said first and second solenoid valves in a position in which said engaging member in contact with said stop can close said limit switch, thereby energizing said first solenoid valve, whereby fluid is supplied into said first piston and cylinder assembly so as to move said engaging member in a first direction in which it is disengaged from said stop, said limit switch being made open after disengagement of said engaging member from said stop and causing said second solenoid valve to be energized, whereby the fluid is supplied into said first piston and cylinder assembly so as to move said engaging member in a second direction opposite to said first direction.

4. A method for removing full bobbins from a succession of spindles of a spinning machine and applying empty bobbins to the spindles from which the full bobbins have been removed, the spinning machine including a bobbin doffing and donning apparatus, said method comprising:

projecting a stop into a path along which an engaging member, mounted on a portion of a power transmission mechanism structurally associating a doffing bar with a piston and cylinder assembly for tilting said doffing bar, is moved by said piston and cylinder assembly to allow said engaging member to pressure contact against said stop, thereby stopping said doffing bar at an intermediate inclined position in which said doffing bar operates on a refuge support;

releasing said doffing bar from said intermediate inclined position by temporarily supplying fluid into said piston and cylinder assembly so as to move said engaging member in a direction in which it disengages from said stop; and thereafter moving said stop out of the path of said engaging member.

5. A method as claimed in claim 4, comprising stopping the supply of said temporary fluid supply when said engaging member has been moved a predetermined distance in said direction.

6. A method as claimed in claim 5, further comprising detecting said predetermined distance which said engaging member has been moved in said direction by a limit switch which is turned on by said engaging member when said doffing bar is in said intermediate inclined position and is turned off when said engaging member is disengaged from said stop prepartory to the retraction of said stop from the path of said engaging member.

7. A method as claimed in claim 4, comprising stopping the supply of said temporary fluid supply after a predetermined period of time from the beginning of the disengagement of said engaging member from said stop in the path of said engaging member.

* * * * *